United States Patent [19]

LaBounty

[11] 4,017,114

[45] Apr. 12, 1977

[54] MULTIDIRECTIONAL GRAPPLE

[76] Inventor: Roy E. LaBounty, 1607 - 8th Ave., Two Harbors, Minn. 55616

[22] Filed: Nov. 13, 1975

[21] Appl. No.: 631,509

[52] U.S. Cl. ..... 294/88; 214/147 R

[51] Int. Cl.[2] ..... B66C 1/42

[58] Field of Search ..... 294/88, 85, 106, 68, 294/69, 104, 105, 107, 70; 214/147 R, 147 G, 147 AS, 650 R, 653; 37/183 R, 184, 186, 187, 141 T, 142 R, 185

[56] References Cited

UNITED STATES PATENTS

| | | | |
|---|---|---|---|
| 2,908,409 | 10/1959 | Hinders et al. | 214/147 R |
| 3,231,303 | 1/1966 | Le Tourneau | 294/88 |
| 3,305,118 | 2/1967 | Lull | 294/88 |
| 3,802,731 | 4/1974 | LaBounty | 294/88 |
| 3,920,137 | 11/1975 | McCain | 294/88 |

*Primary Examiner*—James B. Marbert
*Attorney, Agent, or Firm*—H. Dale Palmatier

[57] ABSTRACT

A multidirectional grapple for a backhoe unit is disclosed. The backhoe unit includes a boom and a forwardly extending stick pivotally mounted to the boom. A mounting base is pivotally mounted to the forward end of the stick, and the grapple assembly includes a back jaw mounted to the base through a rotatable hydraulic system. The back jaw has pivotally attached to it a hydraulically powered forward jaw with the back and forward jaws being so oriented as to open widely forwardly of the backhoe unit, and to rotate as a unit toward one side or the other so as to bite horizontally into a building or the like. The jaws have arcuate, opposing tines which interleave with one another to crush debris between them. The tines of the back jaw extend downwardly and outwardly of the mounting base in position to rake the ground of debris. The mounting base is hydraulically powered and is pivotal about a horizontal axis transverse of the stick to raise and lower the jaws as a unit.

7 Claims, 5 Drawing Figures

MULTIDIRECTIONAL GRAPPLE

BACKGROUND OF THE INVENTION

My U.S. Pat. No. 3,802,731 describes a grapple assembly for a backhoe unit which was useful, for example, for demolition of buildings, clearing of building sites, and raking of the ground to remove small articles of debris. The grapple unit included a stationary lower jaw which was mounted to the forwardly extending stick of a backhoe unit, and also an upper jaw which was closeable upon the lower jaw to crush debris therebetween.

Although the above-described grapple assembly has proved valuable for its intended purposes, it has several limitations which have proved undesirable. The lower or back jaw of the grapple assembly was capable of scraping or raking the ground only in a forward, or outward, direction from the swinghouse of the backhoe; similarly, only a frontal attack could be made by the jaws of the grapple upon a building to be demolished. Further, long objects such as pipes or lengthy timbers, which tend to become aligned transversely in the jaws, could be properly placed in a suitable elongated truck bed or the like only by moving the backhoe itself so as to align the pipe or timbers longitudinally with the truck bed. Also, the orientation of the back jaw to the ground could be adjusted only through adjustments of the boom or stick connecting the back jaw to the swinghouse of the backhoe. Such adjustments for the purpose of properly orienting the back jaw limit the remaining freedom of the stick and boom to move the jaws as desired.

A grapple assembly for a backhoe unit which would avoid the problems discussed above, and which would permit the jaws of the grapple assembly to be properly oriented without requiring gross motions of the stick or boom, is greatly to be desired.

SUMMARY OF THE INVENTION

The present invention provides a grapple assembly for a backhoe having a swinghouse, a vertically swingable boom extending outwardly from the swinghouse, and a forwardly extending stick pivotally mounted to the boom. The grapple assembly includes a mounting base mounted to the forward end of the stick for supporting jaws of the grapple. The grapple jaws include a generally downwardly extending back jaw having arcuate tines, the back jaw being mounted at its upper end to the mounting base through a rotatable hydraulic means capable of rotating the back jaw toward one side or the other from a normal, generally forwardly concave position. The grapple includes a hydraulically powered forward jaw pivotally mounted to the back jaw and having arcuate tines positioned to close downwardly toward and interleave with the tines of the back jaw to crush debris therebetween. The forward jaw is openable upwardly widely from the back jaw to form with the back jaw a pair of forwardly open pincers rotatable as a unit by the hydraulic motor toward one side or the other so as to permit the grapple to bite from a plurality of directions horizontally into a building, to rake debris on the ground from different directions, and to maneuver an elongated load such as pipe or long timbers for loading into a truck bed without requiring the backhoe unit itself to be moved from its position.

DESCRIPTION OF THE PREFERRED EMBODIMENT

Figures 1, 2:
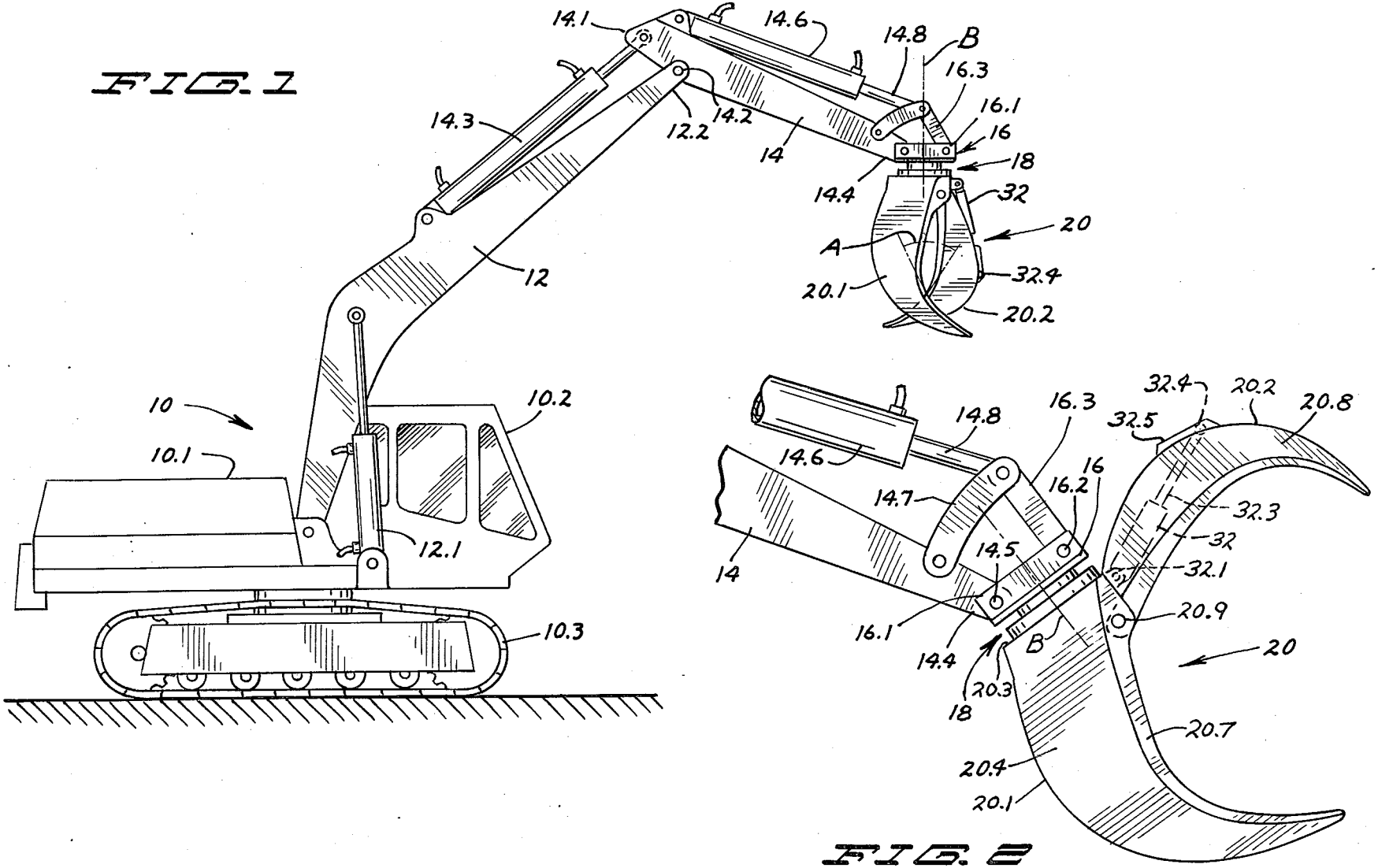
FIG. 1 is a side elevational view of a backhoe unit equipped with a grapple of the invention.
FIG. 2 is an enlarged, broken away side view of the front of the backhoe unit of FIG. 1, showing the jaws of the grapple in an open and tilted position.

Referring first to FIG. 1, there is shown a backhoe unit designated generally as 10 and including a swinghouse 10.1 with control cab 10.2, and a track assembly 10.3 to which the swinghouse is swingably mounted in the usual fashion to permit the swinghouse to swing in a horizontal plane. Pivotally attached to the swinghouse for swinging in a vertical plane is a forwardly extending boom 12. A hydraulic cylinder 12.1 is mounted as shown to swing the boom up and down. A forwardly extending stick 14 is pivotally mounted adjacent its rear end 14.1 to the forward end 12.2 of the boom by means of transverse pivot pin 14.2 to enable the stick to swing up and down in a vertical plane with respect to the boom, and in the same plane as the boom is permitted to swing. A hydraulic cylinder 14.3 is mounted between the boom 12 and the rear end 14.1 of the stick to swing the stick up and down.

Figure 3:
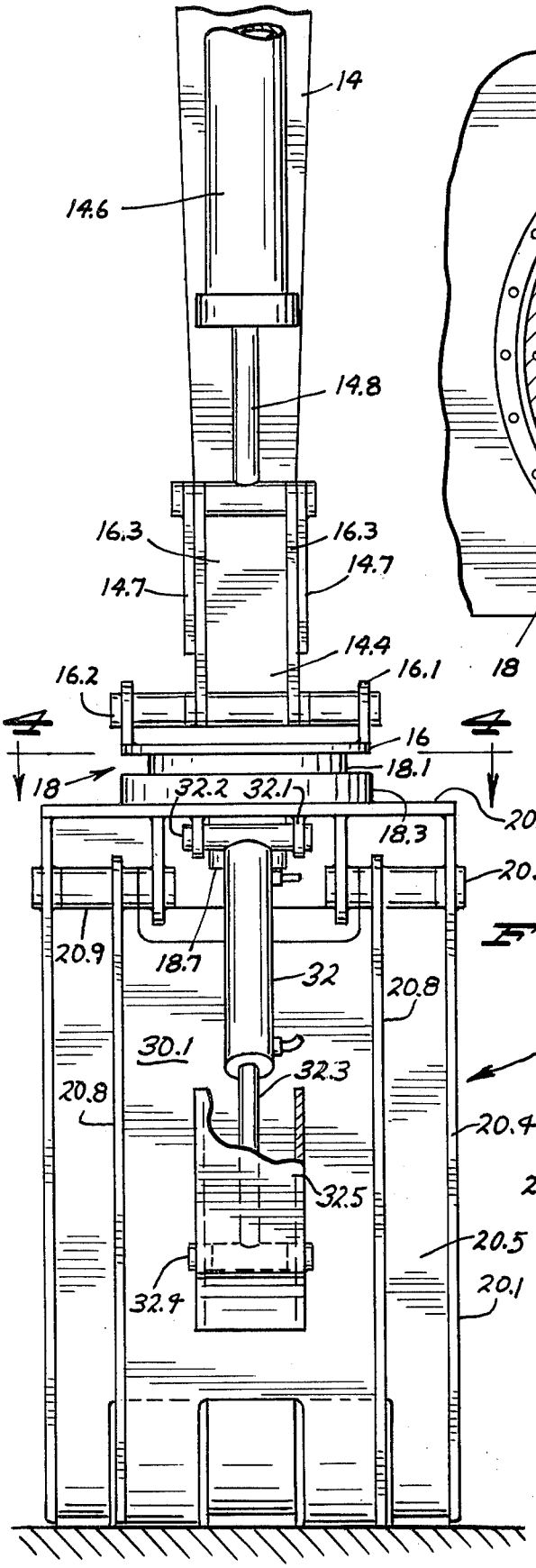
FIG. 3 is a broken away front view of the grapple of the invention with the grapple jaws shown in a closed position.

As shown best in FIGS. 2 and 3, there is provided a mounting base, shown as a mounting plate 16 with upstanding, spaced, parallel ears 16.1 at its side edges. A pivot pin 14.5 passes through the ears adjacent the rear end of the plate 16 and pivotally mounts the plate to the forward end 14.4 of the stick so that the plate can pivot upwardly and downwardly in a vertical plane between, for example, the positions shown in FIGS. 1 and 2. Another pivot pin 16.2 pivotally mounts an upwardly and rearwardly extending link 16.3 to the ears 16.1 of the mounting plate adjacent its forward end, and a hydraulic cylinder 14.6 is mounted to the rear end 14.1 of the stick and extends forwardly for pivotal attachment to the rearward end of the link 16.3. A spacer link 14.7 is connected at its ends to the stick adjacent its forward end 14.4 and to the pivotal connection between the hydraulic cylinder 14.6 and link 16.3, as shown in the drawing, such that when the piston 14.8 is retracted within the cylinder 14.6, the mounting plate 16 is pivoted upwardly as shown in FIG. 2.

Figure 4:
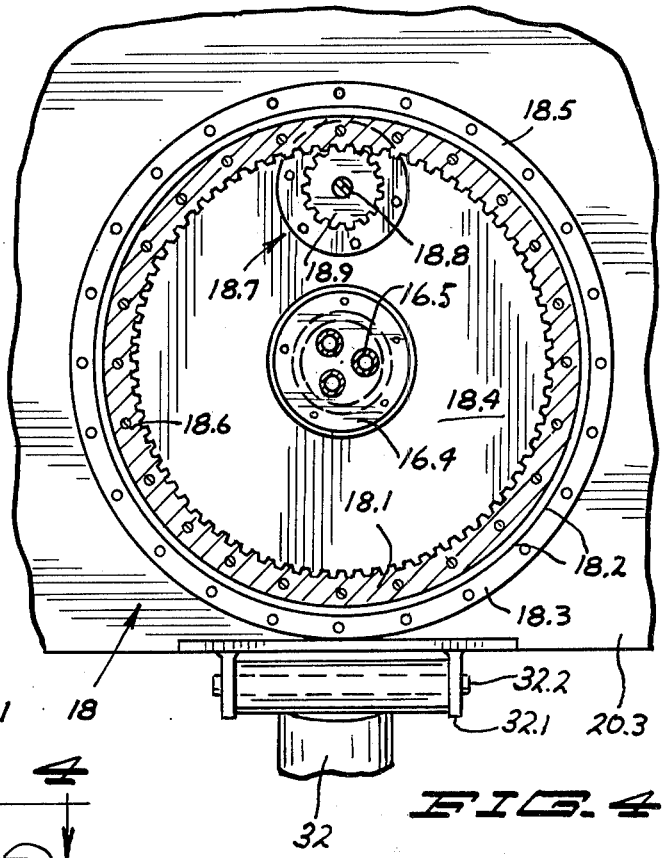
FIG. 4 is a broken away, cross-sectional view taken along line 4—4 of FIG. 3.

The grapple assembly, which is mounted to the mounting plate 16 in a manner to be described, is shown generally as 20 in the drawing, and includes a pair of jaws 20.1, 20.2. One of the jaws 20.1 (hereinafter termed the "back" jaw) is mounted to the mounting plate 16 by means of a hydraulic motor and gear system shown generally as 18 in the drawing. The rotatable hydraulic means 18 may be any of several commercially available systems, and may employ an orbit motor such as that manufactured by the Char-Lynn Company as the 3000 Series, 4000 or 6000 Series motors. With reference particularly to FIGS. 3 and 4, the rotatable hydraulic system includes an inner annular ring gear 18.1 which is mounted at its upper end to the mounting plate 16. Rotatably mounted to the ring gear 18.1 by means of appropriate bearings 18.2 is an outer annular ring 18.3, the latter in turn being mounted to a plate 18.4 by means of bolts 18.5 or the like. The ring gear 18.1, which is mounted by means of bolts 18.6 to the mounting plate 16, is stationary with respect to the mounting plate and is coaxial with the outer annular ring 18.3, the outer annular ring being capable of rotating, by means of the bearings 18.2, about the ring gear 18.1.

A hydraulic motor 18.7 of the type described above is mounted to the bottom plate 18.4 to which the outer annular ring 18.3 is mounted, and has a rotatable shaft 18.8 which extends upwardly through the bottom plate and terminates in a pinion gear 18.9 which meshes with the teeth of the ring gear 18.1, as shown best in FIG. 4 such that as the pinion gear is rotated by the shaft 18.8, the bottom plate 18.4 is rotated about its axis in the opposite direction. As will be understood from the drawing, the mounting plate 16 and the bottom plate 18.4 of the gear assembly are parallel, and the bottom plate is rotatable with respect to the mounting plate about an axis "B" normal to the plate. The plate 18.4 is attached to, or may comprise, an upper plate 20.3 of the back jaw 20.1 of the grapple, the sides 20.4 of the back jaw being welded or otherwise firmly affixed to, and extending downwardly from, the plate 20.3. The back jaw 20.1 may be of the type shown in my U.S. Pat. No. 3,802,731, the jaw including a back plate 20.5 supported by the sides 20.4 and by internal ribs (not shown) parallel to the sides. The jaw terminates downwardly in a series of spaced, parallel tines 20.6 which extend downwardly and forwardly in position to rake the ground. As shown in FIG. 2, the forward edges of the sides 20.4 may have a margin 20.7 of increased width to rigidify the jaw and to provide a reasonably broad surface for contacting pipes or timbers which may extend from the sides of the jaws, as will be described in greater detail below. As thus described, the back jaw 20.1 presents a generally forwardly concave, scoop-like structure bounded at its rear by the rear wall 20.5 and at its sides by the sides 20.4

The opposing jaw 20.2, hereinafter termed the "forward" jaw, includes generally arcuately shaped, spaced side walls 20.8 which are pivotally connected at their upper ends to the back jaw by means of aligned pivot pins 20.9, the pivot pins passing through the reinforced side wall portions 20.7 of the back jaw at points spaced downwardly (FIG. 2) a short distance from the plate 20.3 of the back jaw. By means of the pivot pins 20.9, the forward jaw 20.8 is permitted to swing outwardly and upwardly from the back jaw, as shown in FIG. 2, and to close downwardly upon the back jaw as shown in FIG. 1. The edges of the sides of the forward jaw facing the back jaw have thickened portions 30 (FIG. 2) to increase stiffness of the forward jaw and to provide a wide bearing surface for contact with poles or the like which may be grasped between the thickened portions 20.7 of the back jaw and 30 of the forward jaw. The structure of the forward jaw 20.2 is similar to that of the back jaw 20.1, in that the forward jaw includes a transverse plate 30.1 extending between its sides 20.8. The forward jaw terminates outwardly in a series of arcuate tines 30.2 having a curvature opposed to the curvature of the tines 20.6 of the back jaw. The tines 30.2 of the forward jaw are spaced so as to interleave with the tines of the back jaw, as shown best in FIGS. 1 and 5. The back jaw is preferably wider than the forward jaw, and has an extra tine to provide spaces between the back jaw tines into which the tines of the forward jaw may be received. Desirably, the back jaw has three tines whereas the forward jaw has two tines, as shown in the drawing. The edges of the outermost tines of the back and forward jaws preferably are coextensive with the walls 20.4, 20.8 of these jaws so that the difference in width between the forward and back jaws is approximately equivalent to the width of two of the back jaw tines, as can be seen from FIG. 5. The length of the tines of the jaws, and their curvature, is such that when the jaws are in their closed position as shown in FIG. 1, the jaws interleave with one another so as to form an acute included angle therebetween, the angle being shown as A in FIG. 1, so that debris or other material is crushed between the jaws.

A hydraulic cylinder 32 is attached at one end to the forward edge of the plate 20.3 of the back jaw by means of a pivot pin 32.2 passing through the end of the cylinder and through mounting ears 32.1 which project forwardly slightly of the front edge of the back jaw. The piston 32.3 of the cylinder extends outwardly for connection by means of a pivot pin 32.4 to the forward jaw at a point spaced approximately midway along the length of the forward jaw and adjacent its back wall 30.1, the back wall having a generally rectangular housing 32.5 mounted thereto for protection of the piston and its pivotal connection to the forward jaw. The hydraulic cylinder 32 is so positioned that when it retracts, as shown in FIG. 2, the forward jaw is retracted forwardly and upwardly into an open position. As the piston 32.3 is extended, on the other hand, the forward jaw closed downwardly upon the back jaw as shown in FIG. 1.

Figure 5:
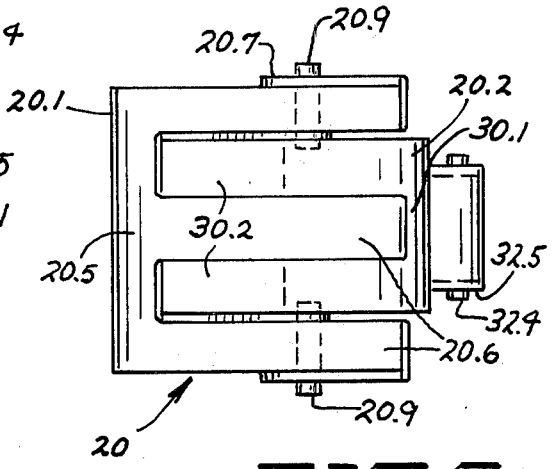
FIG. 5 is a bottom view of the grapple shown in FIG. 3.

The tines 30.2 and 20.6 of the forward and back jaws, respectively, desirably are extensions of the back walls 30.1 and 20.5 of these jaws, and the edges of the interleaving tines are preferably closely adjacent one another as shown in FIG. 5 so that as the forward jaw closes upon the back jaw, the tines interleave to substantially close the bottom of the jaws. In this manner, even small objects can be readily picked up by the grapple.

The base plate 16 is provided centrally with a cylindrical rotary hydraulic fluid connector 16.4 which extends through the plate 18.4 and through which pass hydraulic fluid lines designated generally as 16.5 for supplying hydraulic fluid to the rotary hydraulic motor 18.7 and to the hydraulic cylinder 32.

In use, the jaws of the grapple may be opened widely as shown in FIG. 2 so as to bite generally horizontally and from a variety of directions into a building to be demolished, to crush the debris from the building between the jaws, and to transport the debris to a truck bed or the like. The back jaw can be lowered to the ground with its tines so oriented as to permit scraping or raking of the ground with the tines to move or capture debris of various sizes such as tree limbs, bricks, and the like. Operation of the rotary hydraulic means 18 causes the back jaw and the forward jaw, as a unit, to rotate about the axis of rotation B of the hydraulic system, which axis is generally aligned with the length of the back jaw. Thus, long items of debris such as timbers, pipes and the like, which become generally aligned transversely of the grapple jaws as they are picked up, may be rotated by operation of the rotary hdyraulic system so that the debris may be aligned with the bed of a truck or the like without requiring that the backhoe unit be moved from its normally stationary position.

When the mounting base 16 is tilted from the generally horizontal position shown in FIG. 1, the center of gravity of the grapple is not vertically aligned with the rotatable hydraulic means, but the latter is of sufficient strength to withstand the uneven load thereby encountered. At least one of the annular rings 18.1, 18.3 has a diameter at least half the side-to-side width of the back jaw to provide heavy duty support for the grapple. By tilting the mounting base 16 upwardly, as shown in FIG. 2, the tines of the back jaw may be advanced so as to dig under and cradle an item of debris, such as a wrecked automobile, and the jaws may then be closed to grip the automobile and carry it to a compactor or the like. If the automobile is not in a level position, the grapple may be rotated about the axis B so as to align itself with the car for easy gripping. Although the grapple asssembly is ordinarily rotated about the axis B when the jaws are closed and in a generally vertical position, as shown in FIG. 1, the jaws may be similarly rotated about the axis B when the jaws are closed and in a generally vertical position, as shown in FIG. 1, the jaws may be similarly rotated about the axis B when the mounting base 16 is in its tipped position as shown in FIG. 2, the grapple rotation coacting with the articulation of the base 16 through the links 14.7 and 16.3 to enable the grapple jaws to approach debris or other material from a variety of attack angles and positions, thereby lending great flexibility to the grapple asssembly and thereby greatly increasing the ease with which debris may be picked up and moved, and reducing considerably the time required to finish a debris-moving job. Of interest, when the base 16 is tilted as shown in FIG. 2, and the jaws of the grapple are rotated as a unit about the axis B from the position shown in FIG. 2, a single tine of the lower jaw may be dug into the ground to remove, for example, electric cables or the like. Moreover, the tilting movement of the base 16 permits the orientation of the grapple jaws with respect to the ground or the like to be adjusted very finely, in contrast to the relatively gross adjustments permitted by the grapple assembly of my U.S. Pat. No. 3,802,731.

It will also be noted that the jaws of the grapple assembly, when wide open and with the back jaw in the position shown in FIG. 1, may be rotated toward one side or the other as desired so as to present the wide open jaws at various attack angles to a building to be demolished.

Although the difference in the tilt angle of the mounting base 16 in FIGs. 1 and 2 is on the order of 40°, the base capable of tilting upwardly or downwardly to much greater angles, and desirably can pivot through 180° about the pivot pin 14.5. Thus, the high degree of flexibility afforded the jaws by the swingable mounting base 16 and the rotary hydraulic systems 18 permits the jaws to move into various positions to do jobs not possible with the grapple of my previous U.S. Pat. No. 3,802,731. Further, as described above, both of the jaws are generally scoop-shaped, permitting the jaws to hold a considerable volume of debris such as small stones or the like.

While I have described a preferred embodiment of the present invention, it should be understood that various changes, adaptations, and modifications may be made therein without departing from the spirit of the invention and the scope of the appended claims.

What is claimed is:

1. A multidirectional grapple for a backhoe having a swinghouse, a vertically swingable boom extending outwardly from the swinghouse, and a forwardly extending, hydraulically powered elongate stick mounted to the boom, a tiltable base swingably mounted on the stick for tilting about a horizontal tilt axis extending transversely of the stick, the base having a hydraulic cylinder connected to the stick to control tilting of the base, the grapple including coacting back and forward jaws of which the back jaw has generally downwardly and outwardly extending arcuate, spaced tines; rotatable hydraulic means on the base and mounting the back jaw at its upper end to the base to rotate the back jaw about a rotation axis extending generally along the tines and transversely of the tilt axis, to facilitate turning the back jaw toward one side or the other from a normal position in which the tines of the back jaw extend downwardly and forwardly in position to forwardly rake the ground, the back jaw being movable relative to the base only about said rotation axis; the forward jaw being pivotally mounted at its upper end to the back jaw and having arcuate tines curved oppositely to the tines of the back jaw, the forward jaw being hydraulically powered and positioned to close toward and interleave with the tines of the back jaw to crush debris therebetween; the forward jaw being openable widely from the back jaw, and the jaws being rotatable as a unit by the rotatable hydraulic means toward one side or the other to bite horizontally into a building, to rake debris from the ground, and the like.

2. A multidirectional grapple for a backhoe having a swinghouse, a vertically swingable boom extending outwardly from the swinghouse, and a forwardly extending, hydraulically powered elongate stick mounted to the boom, a mounting base swingably mounted to the forward end of the stick for swinging in a vertical plane, a hydraulic cylinder arranged to tilt the mounting base upwardly and downwardly, the grapple including coacting back and forward jaws of which the back jaw has generally downwardly and outwardly extending arcuate, spaced tines; rotatable hydraulic means mounting the back jaw at its upper end to the base to rotate the back jaw toward one side or the other from a normal position in which the tines of the back jaw extend downwardly and forwardly in position to forwardly rake the ground, the rotary hydraulic means includes a hydraulic motor and a pair of supporting, coaxial rings rotatably mounted to one another and of which one ring is mounted to the mounting base and the other ring is mounted to the back jaw to rotate the latter about the axis of rotation of the rings in response to rotation of the hydraulic motor, at least one of the rings having a diameter of not less than half the side-to-side width of the lower jaw to provide heavy duty support for the jaws when the center of gravity of the latter is not vertically aligned with the mounting base; a hydraulically powered forward jaw pivotally mounted at its upper end to the back jaw and having arcuate tines curved oppositely to the tines of the back jaw, and positioned to close toward and interleave with the tines of the back jaw to crush debris therebetween; the forward jaw being openable widely from the back jaw, and the jaws being rotatable as a unit by the rotatable hydraulic means toward one side or the other to bite horizontally into a building, to rake debris from the ground, and the like.

3. In combination, a backhoe and a multidirectional grapple assembly therefor, the backhoe including a swinghouse, a vertically swingable boom extending outwardly from the swinghouse, and a forwardly extending stick pivotally mounted to the boom for swinging in a vertical plane, the grapple assembly including a mounting base plate swingably mounted to the forward end of the stick for swinging in a vertical plane, a hydraulic cylinder arranged to tilt the base plate upwardly or downwardly from a normal horizontal position, a generally downwardly extending back jaw having elongate and arcuate tines which extend downwardly and forwardly when the jaw is in a forward-facing position, rotary hydraulic means mounting the back jaw at its upper end to the base mounting plate and having an axis of rotation extending normal to the base plate and about which the back jaw may rotate, the back jaw being non-tiltable relative to the base plate, a hydraulically powered forward jaw pivotally mounted to the back jaw and having arcuate tines of opposite curvature to those of the back jaw and positioned to close downwardly toward and interleave with the tines of the back jaw to crush debris therebetween, the forward jaw being openable widely from the back jaw to permit the opened jaws to bite horizontally into a building or the like to be demolished, and the back jaw and forward jaw being rotatable as a unit about the axis of rotation of the rotary hydraulic means to permit the jaws to face toward one side or the other of their normally forwardly facing open position and so as to present various angles of attack of the jaws to debris or the like to be crushed therebetween.

4. In combination, a backhoe and a multidirectional grapple assembly therefor, the backhoe including a swinghouse, a vertically swingable boom extending outwardly from the swinghouse, and a forwardly extending stick pivotally mounted to the boom for swinging in a vertical plane, the grapple assembly including a mounting base plate swingably mounted to the forward end of the stick for swinging in a vertical plane, a hydraulic cylinder arranged to tilt the base upwardly and downwardly from a normal horizontal position, a generally downwardly extending back jaw having arcuate tines which extend downwardly and forwardly when the jaw is in forwardly-facing position, rotary hydraulic means mounting the back jaw at its upper end to the base plate and having an axis of rotation about which the back jaw may rotate, a hydraulically powered forward jaw pivotally mounted on the back jaw and having arcuate tines of opposite curvature to those of the back jaw and positioned to close downwardly toward and interleave with the tines of the back jaw to crush debris therebetween, the back jaw being provided with three spaced tines and the forward jaw being provided with two spaced tines receivable closely in the spaces between the tines of the back jaw to substantially close the outer end of the grapple when the forward jaw is closed upon the back jaw, the forward jaw being openable widely from the back jaw to permit the opened jaws to bite horizontally into a building or the like to be demolished, and the back jaw and forward jaw being rotatable as a unit about the axis of rotation of the rotary hydraulic means to permit the jaws to face toward one side or the other of their normally forwardly facing open position and so as to present various angles of attack of the jaws to debris or the like to be crushed therebetween.

5. The combination according to claim 4 wherein the rotary hydraulic means includes a pair of concentric rings slideably mounted to one another, one ring being mounted to the base plate and the other ring being mounted to the upper end of the lower jaw, at least one of said rings having a diameter at least half the width of the lower jaw to securely mount the latter to the mounting plate and to withstand forces developed when the center of gravity of the jaws is not aligned vertically with the base plate.

6. The combination according to claim 5 in which one of said rings includes circumferential gear teeth and wherein the hydraulic motor includes a pinion gear mating with the gear teeth of the ring to rotate the latter with respect to the other ring.

7. The combination according to claim 5 in which the tines of the jaws are arcuately and oppositely curved so as to interleave with one another at an acute included angle when the forward jaw is closed upon the back jaw, and wherein the jaws have side and back walls providing them with oppositely curved, scoop-shaped interiors.

* * * * *